US007788959B2

(12) United States Patent
Hayashi

(10) Patent No.: US 7,788,959 B2
(45) **Date of Patent: *Sep. 7, 2010**

(54) METHOD OF PRODUCING ULTRA THIN WALL METALLIC TUBE BY COLD DRAWING PROCESS

(75) Inventor: Chihiro Hayashi, Miyagi (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/289,112

(22) Filed: Oct. 21, 2008

(65) Prior Publication Data

US 2009/0193868 A1 Aug. 6, 2009

Related U.S. Application Data

(63) Continuation of application No. PCT/JP2008/051619, filed on Feb. 1, 2008.

(51) Int. Cl.
*B21C 1/24* (2006.01)
*B21D 39/08* (2006.01)

(52) U.S. Cl. ..... 72/283; 72/291; 72/370.06

(58) Field of Classification Search ..... 72/283, 72/287, 290, 291, 370.01, 285, 370.14, 370.02, 72/370.06, 370.1, 370.11, 274, 278, 370.25
See application file for complete search history.

(56) References Cited

U.S. PATENT DOCUMENTS 5,533,376 A * 7/1996 Wetzels et al. ..... 72/283

FOREIGN PATENT DOCUMENTS

| | | | |
|---|---|---|---|
| JP | 57-44429 | | 3/1982 |
| JP | 57044429 | A * | 3/1982 |
| JP | 7-195115 | | 8/1995 |
| JP | 2006-341299 | | 12/2006 |
| WO | 2006/126565 | A1 | 11/2006 |

OTHER PUBLICATIONS

"Iron and Steel Handbook third edition", vol. 3, (2) Steel Bar, Steel Tube, and Rolling Common Facilities, pp. 1158-1183.

* cited by examiner

*Primary Examiner*—Dana Ross
*Assistant Examiner*—Debra M Sullivan
(74) *Attorney, Agent, or Firm*—Clark & Brody

(57) ABSTRACT

In a method of producing an ultra thin wall metallic tube by a cold drawing process in which a drawing machine is used, a wall thickness of the metallic tube is reduced to perform drawing while a tube-wall centerline diameter of a tube material is expanded, using a solid die which gradually increases in diameter from its engaging inlet side toward its work-ending outlet side and a plug or a tapered mandrel bar which gradually increases in diameter over a corresponding distance from the engaging inlet side of the solid die toward the work-ending outlet side of the solid die, whereby the wall thickness can dramatically be reduced.

1 Claim, 2 Drawing Sheets

METHOD OF PRODUCING ULTRA THIN WALL METALLIC TUBE BY COLD DRAWING PROCESS

This application is a continuation of International Patent Application No. PCT/JP2008/051619, filed Feb. 1, 2008.

TECHNICAL FIELD

The present invention relates to a method of cold-drawing a metallic tube, particularly to a method of producing an ultra thin wall metallic tube by a cold drawing process while a producible range is dramatically enlarged on the thin wall side of the metallic tube.

BACKGROUND ART

The metallic tube in a hot finished condition is subjected to a cold working process, when the metallic tube does not satisfy requirements in quality, strength, or dimensional accuracy. Generally, examples of the cold working process include a cold drawing process in which a plug or a mandrel and a die are used and a cold rolling process in which a cold pilger mill is used.

In the cold drawing process, a tube end of a mother tube is swaged by a swaging machine; acid pickling is performed to remove a surface scale and the like; and lubricating treatment is performed to draw the mother tube through a die. Examples of the cold drawing process include plug drawing, drawing by using a floating plug, drawing by using a mandrel bar, and sinking drawing without a plug. All the cold drawing processes are performed by diameter reduction working with the die (for example, see "Iron and Steel Handbook third edition" vol. 3, (2) Steel Bar, Steel Tube, and Rolling Common Facilities, pp. 1158 to 1183).

FIG. 1 is an explanatory view showing a diameter reducing drawing process, FIG. 1A shows the plug drawing, and FIG. 1B shows the drawing by using the mandrel bar.

The plug drawing shown in FIG. 1A is a most common drawing process. In the plug drawing, a plug 3, which includes plug support rod 4, is inserted into a mother tube 1, the tube end of the mother tube 1 is gripped with a chuck 6, and the mother tube 1 is drawn through a die 2 in the direction shown by an arrow X in FIG. 1. The plug drawing has advantages in plug exchange and operation efficiency, and also allows a large reduction rate.

The drawing by using the mandrel bar shown in FIG. 1B is a process, in which a mandrel bar 5 is inserted into a mother tube 1 and the mother tube 1 with mandrel bar is drawn through a die 2 like plug drawing shown in FIG. 1A. In the drawing by using the mandrel bar, since the working of tube inner surface is performed by the mandrel bar, a product tube 7 having a glossy inner surface can be produced with high dimensional accuracy even in small diameter tubes. Therefore, the drawing by using the mandrel bar is used in producing a high grade tube for use in nuclear power plants and the like.

Most drawing machines used in the cold drawing are driven by a motor with a chain, but some drawing machines are driven hydraulically using medium of either oil or water.

In the metallic-tube cold drawing process, friction resistance is generated between the outer surface of tube material and the die surface and between the inner surface of tube material and the surface of the plug or mandrel bar, and the drawing is performed against the friction forces. Therefore, tension is generated in a longitudinal direction of tube material. Given tension stress is defined as: tension divided by post-drawing sectional area, when the tension stress becomes high, there occurs a phenomenon that the drawn tube diameter gets unexpectedly smaller, and the tube may rupture in the event that the tension stress reaches a deformation resistance of the tube material. Obviously, the thinner the wall thickness of the tube becomes, the more the tension stress is increased in a longitudinal direction, whereby the tube is ruptured easily. Therefore, there is inevitably a limit to a reduction rate of the wall thickness. Accordingly, in the drawing with the large reduction rate of the wall thickness, it is necessary that the number of drawing be increased to repeat the drawing, and the lubricating work is required in each case, which results in cost increases. In the case where work hardening is significantly generated in the tube material, annealing is also required.

DISCLOSURE OF THE INVENTION

In view of the above problems, an object of the present invention is to propose a method of producing an ultra thin wall metallic tube by a cold drawing process in which a producible range can be dramatically enlarged on the thin wall side of the metallic tube. Although the present invention is mainly directed to a thin wall seamless metallic tube, a welded metallic tube is also included in the target of the present invention, since the welded metallic tube is required to correct the uneven wall thickness generated in a welded part or a heat affected zone of the thin wall welded metallic tube.

The inventor conducted the research and development to solve the above problem based on the issues of the prior art, and the inventor obtained the following findings to complete the present invention.

Generally, in plastic working of tube materials, the wall thickness reduction is achieved by elongating the tube material in a longitudinal direction of tube. That is, in the cold drawing of tube materials, when the wall thickness is reduced between the die and the plug or mandrel bar, the drawing is performed while the diameter of the tube is reduced, and the tube is elongated in the longitudinal direction. Thus, as long as the elongation is performed only in a longitudinal direction, the reduction amount of wall thickness is considerably restricted to thereby make it difficult to enlarge available range on the thinner wall side.

The inventor has interpreted the above fact as meaning that since, when the wall thickness of the tube material is reduced by the plastic working, the elongation is performed only in a longitudinal direction, the reduction amount of wall thickness is restricted to thereby make it difficult to enlarge available range on the thinner wall side. Then, the inventor hits upon an idea that the above problem could be avoided when the tube material is elongated in a circumferential direction while elongated in a longitudinal direction in reducing the wall thickness of the tube material by the cold drawing process. When the rolling performed to a ring-shaped product by a ring rolling mill is studied as an extreme case, a ring-shaped blank material is elongated not in a longitudinal direction (axial direction) but only in a circumferential direction of the ring, so that the wall thickness can be infinitely reduced.

In order to elongate the tube material in a longitudinal direction while elongating it in a circumferential direction in the drawing process, it is necessary that the drawing be performed to reduce the wall thickness while the diameter of the tube material is expanded by using a solid die and a plug or a tapered mandrel bar, the die gradually increasing in diameter from its engaging inlet side toward its work-ending outlet side, either the plug or the tapered mandrel also gradually increasing in diameter over a corresponding distance from the engaging inlet side of toward the work-ending outlet side of the solid die.

The present invention is made based on the above findings, and the gist thereof pertains to a method of producing an ultra thin wall metallic tube by a cold drawing process shown in the following aspects (1) to (3).

(1) A method of producing an ultra thin wall metallic tube by a cold drawing process in which a drawing machine is used, the method including the steps of feeding a mother tube having an expanded tube-end portion into a solid die, the die increasing in diameter from its engaging inlet side toward its work-ending outlet side, inserting a plug or a tapered mandrel bar, either the plug or the tapered mandrel gradually increasing in diameter over a corresponding distance from engaging inlet side of the solid die toward work-ending outlet side of the solid die, into the mother tube, and drawing the mother tube from the engaging inlet side toward the work-ending outlet side by gripping the expanded tube-end portion with a chuck, whereby a wall thickness of the mother tube is reduced to perform elongating while inside and outside diameters are simultaneously expanded between the solid die and the plug or tapered mandrel bar. At this point, obviously the wall thickness cannot be reduced, unless an expansion amount of the inside diameter is ensured larger than that of the outside diameter.

(2) In the aspect (1), the plastic deformation in which the wall thickness is reduced while the inside and outside diameters are simultaneously expanded is described. However, the diameter expansion deformation of the tube material does not always require the plastic deformation in which the inside and outside diameters are simultaneously expanded. From the view of mechanics of plasticity, the plastic deformation that entails the expansion of a tube-wall centerline diameter (the mean diameter of inside and outside diameters) is collectively referred to as diameter expansion deformation.

Accordingly, since the tube-wall centerline diameter is surely expanded even if only the inside diameter is expanded while the outside diameter is not changed, it is also included in the category of the diameter expansion deformation.

(3) When, even if the outside diameter is reduced, an expansion amount of the inside diameter is larger than a reducing amount of the outside diameter, the tube-wall center line diameter is expanded, and it is also included in the category of the diameter expansion deformation.

As used herein, a diameter expansion ratio of inside or outside diameter shall mean a ratio in which the inside or outside diameter of the after-cold-drawing metallic tube is divided by the inside or outside diameter of the before-cold-drawing metallic tube. A diameter reducing ratio of the outside diameter shall mean that the diameter expansion ratio of the outside diameter becomes smaller than 1.

BRIEF DESCRIPTION OF THE DRAWINGS

FIGS. 1A and 1B are explanatory views of a conventional diameter reducing drawing, wherein FIG. 1A shows plug drawing, and FIG. 1B shows mandrel drawing which uses a mandrel bar.

FIGS. 2A and 2B are explanatory views of a diameter expansion drawing process according to the present invention in which a wall thickness is reduced to perform elongating while inside and outside diameters are simultaneously expanded, wherein FIG. 2A shows the plug drawing, and FIG. 2B shows the mandrel drawing.

FIGS. 3A and 3B are explanatory views of a diameter expansion drawing process according to the present invention in which the wall thickness is reduced to perform elongating while the inside diameter is expanded and the outside diameter is not changed, wherein FIG. 3A shows the plug drawing, and FIG. 3B shows the mandrel drawing.

FIGS. 4A and 4B are explanatory views of a diameter expansion drawing process according to the present invention in which the wall thickness is reduced to perform elongating while the outside diameter is reduced and the inside diameter is expanded, wherein FIG. 4A shows the plug drawing, and FIG. 4B shows the mandrel drawing.

BEST MODE FOR CARRYING OUT THE INVENTION

As described above, the present invention is a method of producing an ultra thin wall metallic tube by a cold drawing process in which a drawing machine is used. A first aspect of the present invention is a method of producing an ultra thin wall metallic tube by a cold drawing process in which a drawing machine is used, the method includes the steps of: feeding a mother tube having an expanded portion at an end into a solid die, the solid die gradually increasing in diameter from engaging inlet side toward work-ending outlet side; inserting a plug or a tapered mandrel bar, either of them gradually increasing in diameter over a corresponding distance from engaging inlet side of the solid die toward work-ending outlet side of the solid die, into the mother tube; and drawing the mother tube in the direction from the engaging inlet side toward the work-ending outlet side by gripping the expanded tube-end portion with a chuck, whereby a wall thickness of the mother tube is reduced to perform elongating while inside and outside diameters are simultaneously expanded between the solid die and the plug or tapered mandrel bar.

In order to put the diameter expansion drawing process of the tube material into practical use, it is preferable that the operation method of the cold drawing is changed as follows in comparison with the conventional drawing process.

First, a tube-end portion of mother tube is expanded in diameter in a tapered manner by a tube-end expander. For example, a press-expanding technique may be used for the tube-end expander. Second, after the acid pickling and the lubricating treatment are performed to the mother tube having an expanded tube-end, the mother tube is introduced into the solid die from the work-ending outlet side of the solid die and is drawn while being expanded in diameter between the solid die and the plug or tapered mandrel bar, either of them having inner-surface working/restricting diameter larger than the outside diameter of the mother tube. Third, the plug or tapered mandrel bar is also supported from the work-ending outlet side of the die. Although peripheral devices are concentrated on the work-ending outlet side of the die, this provides such a large advantage that the thin wall metallic tube can be drawn.

Figure 1A:
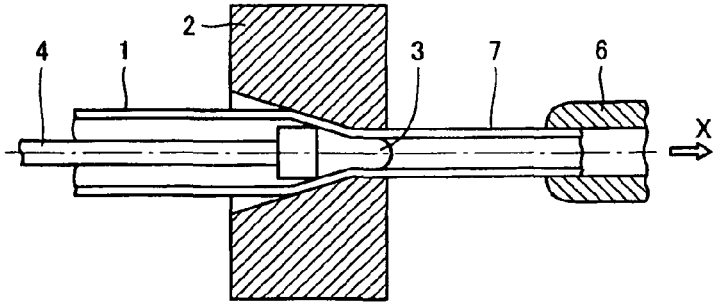
FIG. 1A Prior Art
Figure 1B:
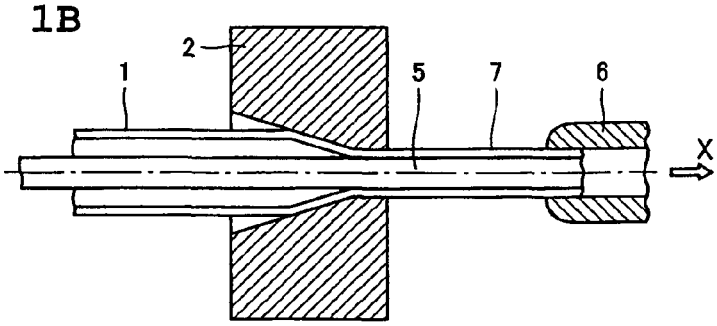
FIG. 1B Prior Art
Figure 2A:
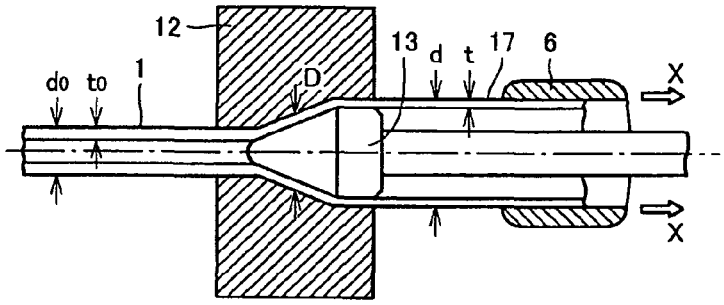
Figure 2B:
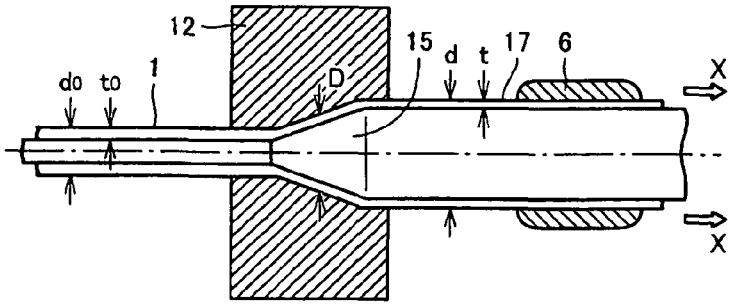

FIG. 2 shows an embodiment of the present invention. FIG. 2A shows plug drawing and FIG. 2B shows mandrel drawing which uses a mandrel bar. As shown in FIGS. 2A and 2B, a solid die 12 increases in diameter from its engaging inlet side (left side of the solid die 12 in FIG. 2) toward its work-ending outlet side (right side of the solid die 12 in FIG. 2), and the mother tube 1 having an expanded tube-end is fed into the solid die 12 from the work-ending outlet side of the solid die 12. A plug 13 or a tapered mandrel bar 15 is inserted into the mother tube 1, the plug 13 or tapered mandrel bar 15 increasing in diameter over a corresponding distance from inlet side of the solid die 12 toward work-ending outlet side of the solid die 12 and the maximum working diameter of the plug 13 or tapered mandrel bar 15 being larger than the outside diameter of the mother tube 1. Then, the mother tube 1 having an expanded tube-end is drawn in the direction shown by an arrow X in FIG. 2 while the expanded tube-end portion of the mother tube 1 is gripped with a chuck 6. Through the operation, the mother tube 1 is drawn while the diameter of the mother tube 1 is expanded between the solid die 12 and the plug 13 or tapered mandrel bar 15.

Through the above process, the mother tube 1 having an outside diameter $d_0$ and a wall thickness $t_0$ is drawn into a drawn tube product 17 having an outside diameter d and a wall thickness t while the diameter of the mother tube 1 is expanded.

Figure 3A:
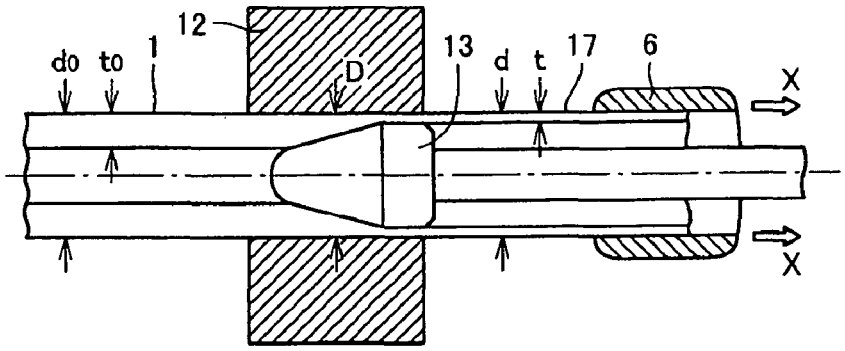
Figure 3B:
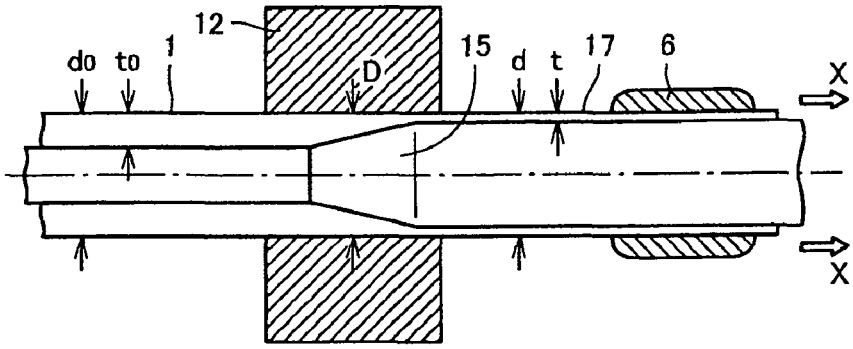
Figure 4A:
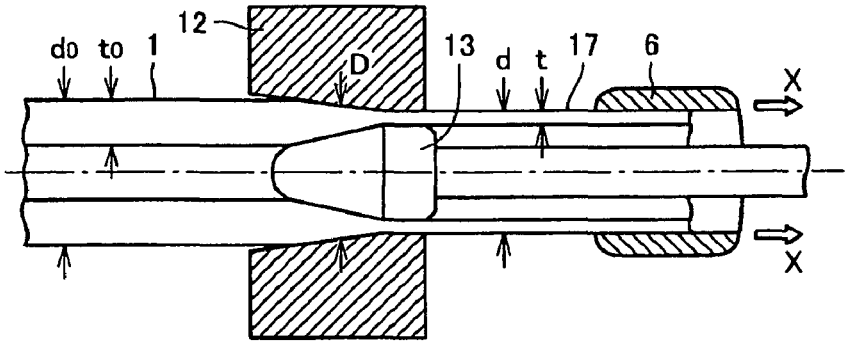
Figure 4B:
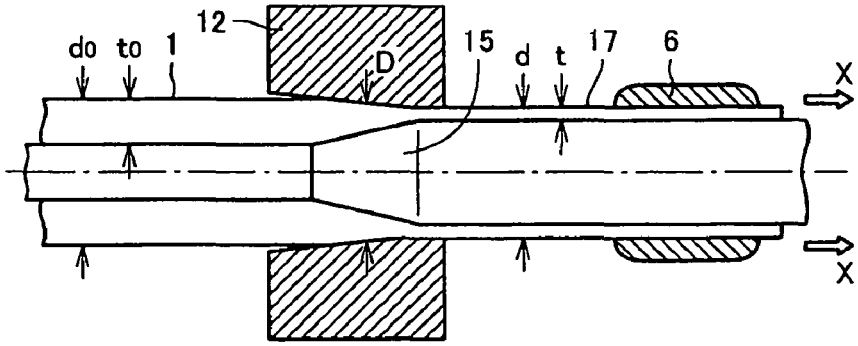

A second aspect of the present invention is a method of producing an ultra thin wall metallic tube by the cold drawing process, in which its wall thickness is reduced to perform elongating while its outside diameter is not changed and only its inside diameter is expanded. A third aspect of the present invention is a method of producing an ultra thin wall metallic tube by the cold drawing process, in which its wall thickness is reduced to perform elongating while its outside diameter is reduced and its inside diameter is expanded, an expansion amount of the inside diameter being ensured larger than a reducing amount of the outside diameter. FIGS. 3 and 4 show embodiments of the present invention. FIGS. 3A and 4A show the plug drawing, and FIGS. 3B and 4B show the mandrel drawing. Through the same process as that of FIG. 2, the drawing is performed while the diameter is expanded between the solid die 12 and the plug 13 or tapered mandrel bar 15.

EXAMPLE

In order to confirm the effects of the method of producing an ultra thin wall metallic tube by the cold drawing process according to the present invention, the following tests of three examples were performed to evaluate the results. Since action and effects of the mandrel drawing are substantially identical to those of the plug drawing, only the plug drawing will be described in the examples.

Example 1

A 18% Cr-8% Ni stainless steel tube having an outside diameter of 34.0 mm and a wall thickness of 3.5 mm produced by the Mannesman-mandrel mill process was used as a mother tube for testing, the mother tube was drawn while its diameter was expanded by the cold drawing process, and the obtained tube had an outside diameter of 50.8 mm and a wall thickness of 1.6 mm.

The test conditions and results are summarized as follows.

Diameter of tapered solid die: D=34.0 to 50.8 mm

Plug diameter: dp=47.5 mm

Mother tube outside diameter: $d_0$=34.0 mm

Mother tube wall thickness: $t_0$=3.5 mm

Outside diameter of tube after drawing: d=50.8 mm

Wall thickness of tube after drawing: t=1.6 mm

Expansion ratio of outside diameter: $d/d_0$=1.49

Elongating ratio: $t_0(d_0-t_0)/\{t(d-t)\}$=1.36

(Wall thickness/outside diameter) ratio: t/d=3.15%

Expansion ratio of centerline diameter of tube wall: $(d-t)/(d_0-t_0)$=1.61

Example 2

A 18% Cr-8% Ni stainless steel tube having an outside diameter of 50.8 mm and a wall thickness of 4.5 mm produced by the Mannesman-mandrel mill process was used as a mother tube for testing, the mother tube was drawn while its diameter was expanded by the cold drawing process, and the obtained tube had an outside diameter of 50.8 mm and a wall thickness of 1.8 mm.

The test conditions and results are summarized as follows.

Diameter of tapered solid die: D=50.8 to 50.8 mm

Plug diameter: dp=47.8 mm

Mother tube outside diameter: $d_0$=50.8 mm

Mother tube wall thickness: $t_0$=4.5 mm

Outside diameter of tube after drawing: d=50.8 mm

Wall thickness of tube after drawing: t=1.8 mm

Expansion ratio of outside diameter: $d/d_0$=1.00

Elongating ratio: $t_0(d_0-t_0)/\{t(d-t)\}$=2.36

(Wall thickness/outside diameter) ratio: t/d=3.54%

Expansion ratio of centerline diameter of tube wall: $(d-t)/(d_0-t_0)$=1.06

Example 3

A 18% Cr-8% Ni stainless steel tube having an outside diameter of 53.4 mm and a wall thickness of 5.5 mm produced by the Mannesman-mandrel mill process was used as a mother tube for testing, the mother tube was drawn while its diameter was expanded by the cold drawing process, and the obtained tube had an outside diameter of 50.8 mm and a wall thickness of 2.0 mm.

The test conditions and results are summarized as follows.

Diameter of tapered solid die: D=53.4 to 50.8 mm

Plug diameter: dp=47.4 mm

Mother tube outside diameter: $d_0$=53.4 mm

Mother tube wall thickness: $t_0$=5.5 mm

Outside diameter of tube after drawing: d=50.8 mm

Wall thickness of tube after drawing: t=2.0 mm

Expansion ratio of outside diameter: $d/d_0$=0.95

Elongating ratio: $t_0(d_0-t_0)/\{t(d-t)\}$=2.70

(Wall thickness/outside diameter) ratio: t/d=3.94%

Expansion ratio of centerline diameter of tube wall thickness: $(d-t)/(d_0-t_0)$=1.02

The steel tubes obtained by the above tests of three examples had glossy inner and outer skin surface, and there was no particular issue in quality. In the 18% Cr-8% Ni stainless steel tube having an outside diameter of 50.8 mm, since an available minimum wall thickness by the conventional diameter reducing drawing process is 2.4 mm or so, it is clear that the diameter expansion drawing process of the present invention has the significant advantage.

INDUSTRIAL APPLICABILITY

The use of the method of producing an ultra thin wall metallic tube by the cold drawing process according to the present invention can dramatically enlarge the producible range on the thin wall side of the metallic tube by the cold drawing process. As a seamless metallic tube having a wall thickness not more than about two-thirds of the conventional cold-finishing seamless metallic tube is economically stably produced by the method of the present invention, thin wall welded metallic tubes such as TIG welded tubes and laser welded tubes can be replaced with the high-reliability ultra thin wall seamless metallic tubes produced by the method of the present invention. When the ultra thin wall seamless metallic tube having a wall thickness in the range from 0.6 to 0.8 mm is stably produced, the ultra thin wall seamless metallic tube can be applied to high-technology fields such as a heating sleeve of a color laser printer, a pressurizing roll of the same, a cell case of a fuel cell, or the like.

What is claimed is:

1. A method of producing an ultra thin wall metallic tube by a cold drawing process in which a drawing machine is used, the method comprising the steps of:

feeding a mother tube into a solid die, the mother tube having an expanded tube-end portion, an inside diameter, and an outside diameter, the solid die having a diameter that gradually decreases from an engaging inlet side toward a work-ending outlet side;

inserting a plug or a tapered mandrel bar into the mother tube, either the plug or the tapered mandrel bar having a diameter that gradually increases in diameter over a corresponding distance from the engaging inlet side of the solid die toward the work-ending outlet side of the solid die; and drawing the mother tube from the engaging inlet side toward the work-ending outlet side by gripping the expanded tube-end portion with a chuck, whereby a wall thickness of the mother tube is reduced to perform elongating while a tube-wall centerline diameter is expanded between the solid die and the plug or tapered mandrel bar, the tube-wall centerline diameter being the mean diameter of the outside and inside diameters of the mother tube, wherein the wall thickness is reduced to perform elongating while the outside diameter is reduced and the inside diameter is expanded, and an expansion amount of the inside diameter being ensured larger than a reducing amount of the outside diameter.

* * * * *